United States Patent [19]

Fischer

[11] Patent Number: 4,799,282

[45] Date of Patent: Jan. 24, 1989

[54] PAD HOLDER RELEASE MECHANISM FOR FLOOR TREATING MACHINES

[75] Inventor: Ernest J. Fischer, Skokie, Ill.

[73] Assignee: Breuer Electric Mfg. Co., Chicago, Ill.

[21] Appl. No.: 110,372

[22] Filed: Oct. 19, 1987

[51] Int. Cl.[4] ..... A47L 11/14

[52] U.S. Cl. ..... 15/98; 15/49 R; 279/22; 279/75

[58] Field of Search ..... 15/28, 29, 49 R, 50 R, 15/98, 385; 51/168, 176, 177; 279/22, 30, 75

[56] References Cited

U.S. PATENT DOCUMENTS

| | | | |
|---|---|---|---|
| 2,008,894 | 7/1935 | Bergstrom | 15/28 |
| 2,290,215 | 7/1942 | Stenberg | 279/75 |
| 2,702,395 | 2/1955 | Zaiger | 15/98 |
| 3,436,086 | 4/1969 | Glenzer | 279/30 |
| 3,860,989 | 1/1975 | Johnston | 15/49 R |
| 4,096,599 | 6/1978 | Mayo | 51/177 |
| 4,468,828 | 9/1984 | Nadolny et al. | 15/28 |
| 4,619,010 | 10/1986 | Burgoon | 15/98 |
| 4,692,073 | 9/1987 | Martindell | 279/75 |

FOREIGN PATENT DOCUMENTS

| | | | |
|---|---|---|---|
| 1063397 | 12/1953 | France | 15/28 |
| 1267147 | 6/1961 | France | 15/28 |

*Primary Examiner*—Edward L. Roberts

*Attorney, Agent, or Firm*—Juettner Pyle Lloyd & Verbeck

[57] ABSTRACT

A pad holder release mechanism for a floor treating machine enables a pad holder to quickly be released from and reattached to a motor shaft, so that a pad carried by the holder may be replaced without need to tip the machine back on its handle. The release mechanism is particularly useful with battery powdered floor treating machines, which because of their weight cannot conveniently be tipped to expose the pad, and if tipped present a risk of battery acid spillage. In use of the mechanism, the pad holder need only be elevated a few inches to lift the pad off of a surface, whereupon the mechanism allows the pad holder and pad to be removed from and replaced on the machine.

10 Claims, 2 Drawing Sheets

PAD HOLDER RELEASE MECHANISM FOR FLOOR TREATING MACHINES

BACKGROUND OF THE INVENTION

The present invention relates to floor treating machines in general, and in particular to a pad holder release mechanism for such machines.

Floor burnishing machines with pad speeds of 2000 rpm and higher are available in both cord electric powered and battery powered versions. Substantially all cord electric burnishers are of the same basic construction. A motor is positioned over a set of wheels, a belt drive system rotates a pad holder through an output shaft, a pad is carried by the holder and a handle is attached to the machine for operator control. To change a pad on such machines, the handle is tilted back to the floor to tip the drive section generally perpendicular to the floor and expose the pad. To remove the pad, a threaded, clipped or otherwise held fastener is removed, usually without the aid of tools, and the pad is then peeled off of the pad holder, while the pad holder is and remains permanently attached to the machine. Because of its relatively light weight (usually less than 150 lbs.) and construction, tipping a cord electric machine back on its handle to expose the pad presents no real problems.

Battery powered floor burnishing machines free the operator from the limitation of a cord and allow more power to be transferred to the floor than is available from a normal 15 amp wall circuit breaker. Battery powered units therefore offer more work output and more mobility. However, a disadvantage of battery powered machines is that the floor treating pad is difficult to change, since such machines usually weigh over four hundred pounds, the majority of which is due to the batteries, and most require pads to be changed by tipping back the entire unit to expose the pad. In addition to being a difficult task physically, and although the machines are designed to be tilted, when tipped the batteries are placed at an awkward angle and the risk of spilling battery acid is high. Depending upon the floor and cleaning operation, the need to change pads can arise as often as every thirty minutes.

Some battery powered floor treating machines have a elaborate mechanism for lifting the pad holder and pad and tilting them generally perpendicular to the floor. While this makes changing the pad considerably easier, it also makes the machine larger than necessary and adds a costly mechanism.

OBJECTS OF THE INVENTION

An object of the invention is to provide a pad holder release mechanism for floor treating machines, that enables a pad holder and pad to quickly and conveniently be removed from a machine.

Another object is to provide such a mechanism in which the entire pad holder, with pad attached, can be removed from the machine without tools.

A further object is to provide such a mechanism, that allows removal of the pad holder without need to tip the machine, so when used with a battery powered machine, changing the pad is made considerably easier and there is no risk of spilling battery acid.

SUMMARY OF THE INVENTION

In accordance with the present invention there is provided, in combination, a floor treating machine having a frame and a rotary output shaft extending from the frame, a pad holder adapted to carry a floor treating pad, and means for releasably connecting the pad holder to an end of the shaft. The releasably connecting means comprises latch means on the pad holder and shaft, and the latch means is operative in response to movement together of the pad holder and shaft to connect the same together for conjoint rotation. Manually manipulatable control means is operatively connected to the latch means, and is movable to a release position to cause the latch means to disconnect the pad holder and shaft. By virtue of the releasably connecting means, the pad holder may conveniently be disconnected from the shaft for replacement of the pad, and then conveniently reconnected to the shaft.

The foregoing and other objects, advantages and features of the invention will become apparent upon a consideration of the following detailed description, when taken in conjunction with the accompanying drawings.

DETAIL DESCRIPTION

Figure 1:
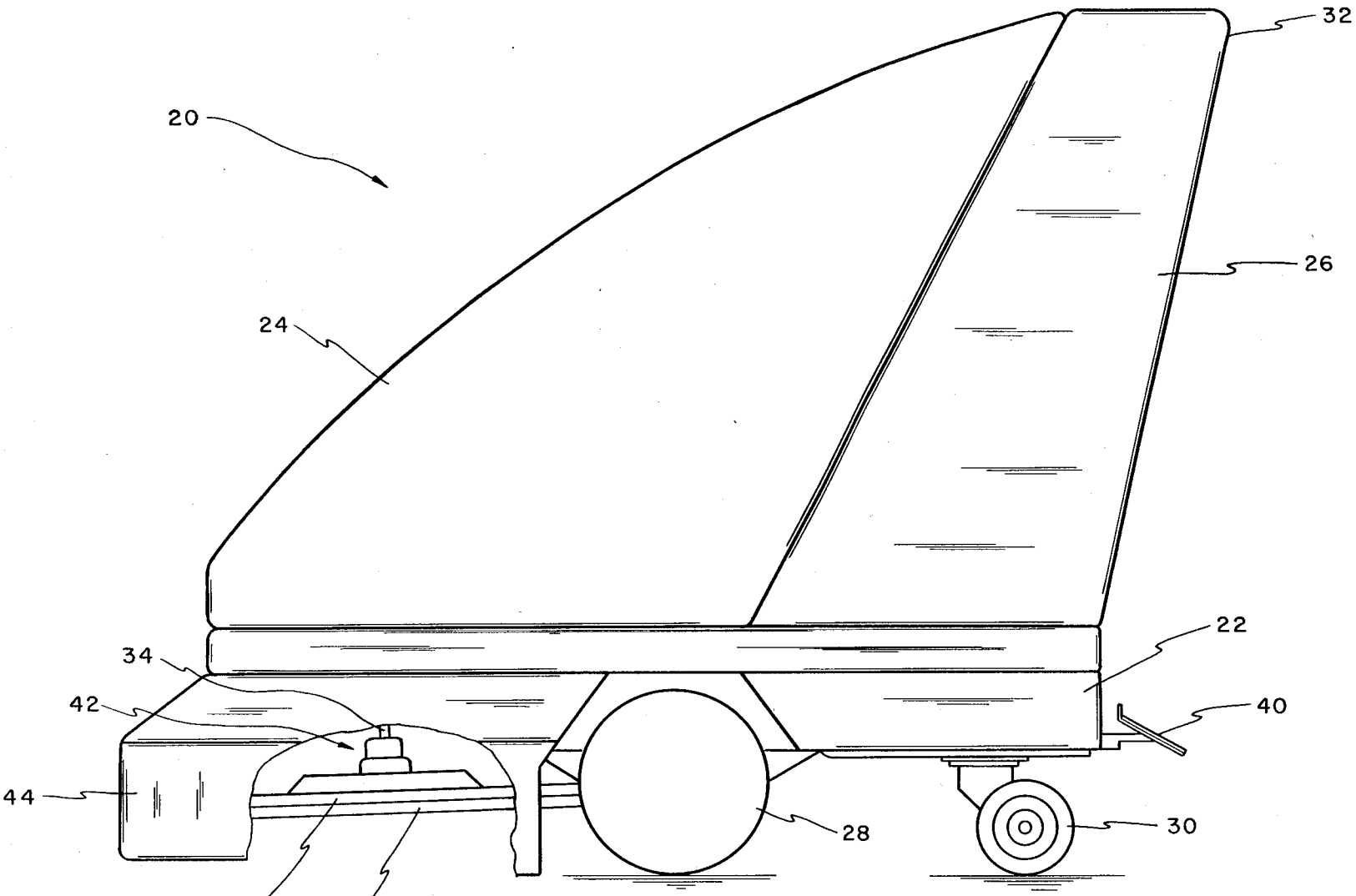
FIG. 1 is a side elevation view of a battery powered floor finishing machine, with which the pad holder release mechanism of the invention may advantageously be used.

FIG. 1 illustrates a battery powered floor maintenance machine of generally conventional configuration. The machine has a base 22 on which are a front cover 24 and rear cover 26, and the base is carried on two pairs of wheels 28 and 30 for movement and transport of the machine. Extending transversely of the machine at an upper end 32 of the rear cover is a handle (not shown), by means of which an operator can guide the machine, and adjacent the handle are controls (also not shown) for operating the machine. Carried on the base within the front cover 24 is an electric motor (not shown), an output shaft 34 of which supports and rotates a pad holder 36 and pad 38 carried by the holder. A motor lift pedal 40 at a rearward end of the machine is operable to raise and lower the motor, and therefore the pad holder and pad, between an upper position where the pad is about 3" above a floor so the machine may be transported on its wheels, and a lower position where the pad is against and in treating relationship with the floor. Batteries (not shown) for powering the electric motor are within the rear cover and a rearward portion of the front cover, and because of the batteries the machine is relatively heavy and usually weighs over four hundred pounds.

Since the machine is battery powered, the operator is freed from the limitations of a cord and has more power available for transfer to the floor than would be allowed through a normal 15 amp wall circuit breaker. The machine therefore offers increased work output and more mobility, but a drawback is that the pad is difficult to change because of the significant machine weight. Most machines require pads to be changed by tipping back the entire unit to expose the pad, and depending upon the floor and nature of the cleaning operation, pad replacement can be as often as every thirty minutes. In addition to being a difficult task physically, when the unit is tilted the batteries are placed at an awkward angle, and there is an increased risk of spilling battery acid. Although the motor lift pedal 40 permits the pad 38 to be lifted several inches above the floor, with conventional machines the pad holder is permanently attached to the motor output shaft, and the limited elevation of the pad is not sufficient for its removal from the pad holder.

Figure 2:
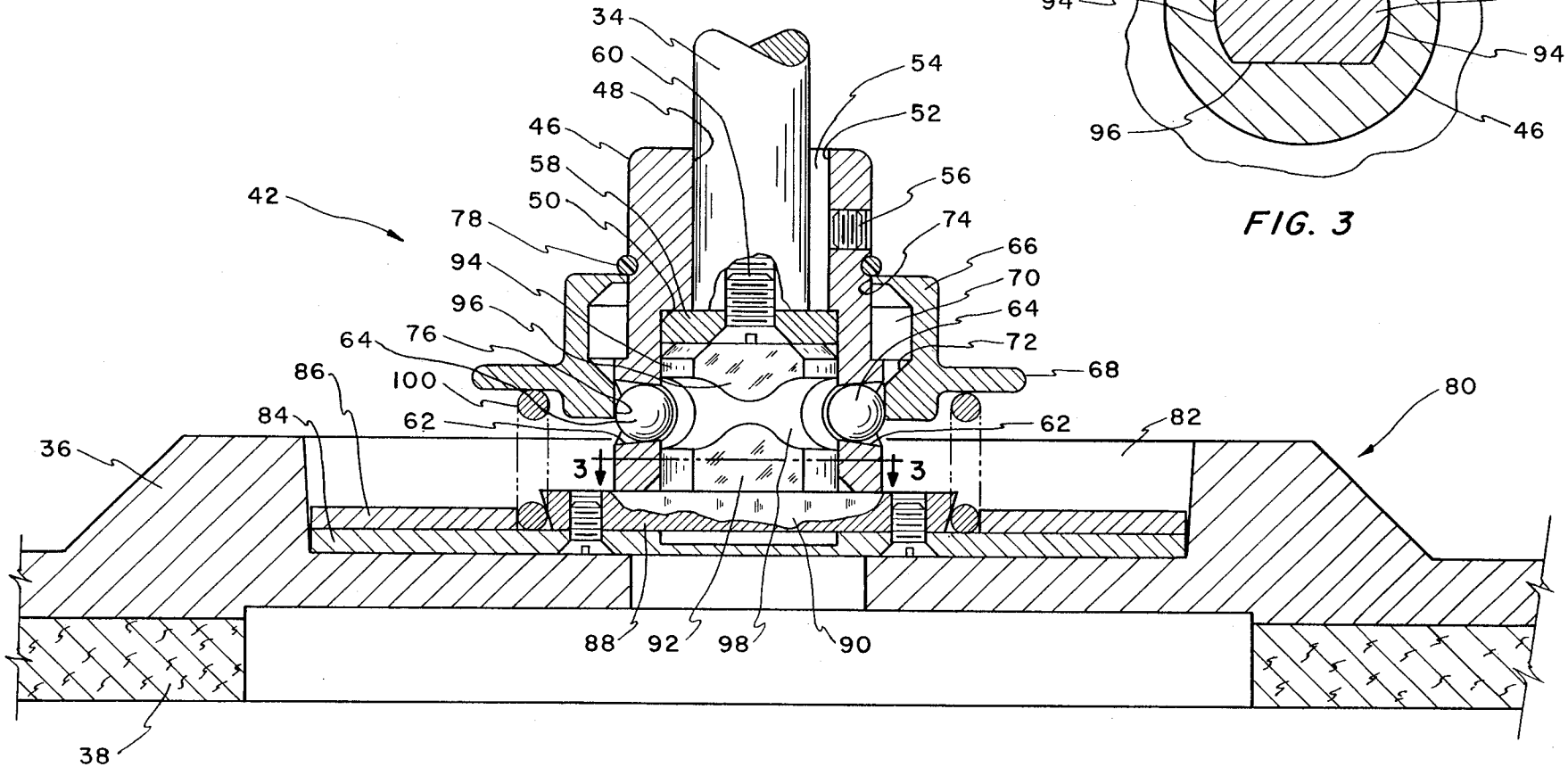
FIG. 2 is a cross sectional side elevation view of the release mechanism and of a pad holder attached to the machine by the mechanism.

Accordingly, and with reference also to FIG. 2, the invention provides a pad holder release mechanism, indicated generally at 42, for releasably attaching the pad holder 36 to the motor shaft 34. With a shroud 44 removed from around the front of the machine and the motor lift pedal 40 operated to raise the pad holder and pad to their upper positions, the mechanism may be actuated by an operator to allow the pad holder and pad to drop away from the motor shaft by gravity and be removed from beneath the machine for convenient replacement of the pad. Once the pad is changed, the mechanism permits the operator to quickly reattach the pad holder to the motor shaft, so that upon replacement of the shroud and lowering of the pad against the floor, the machine is ready to resume a floor treating operation.

Figure 3:
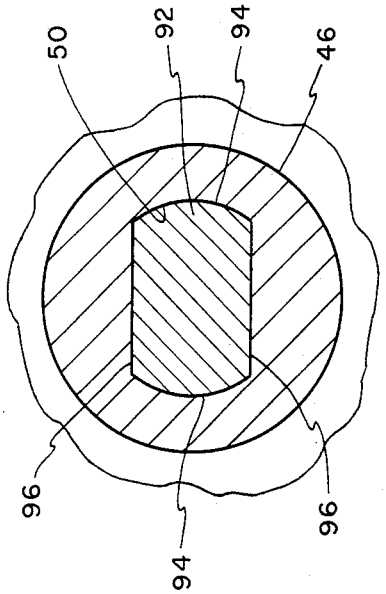
FIG. 3 is a cross sectional top plan view taken substantially along the lines 3—3 of FIG. 2.

More particularly, the pad holder release mechanism 42 includes a tubular or cylindrical member 46, through which extends an upper passage 48 and lower passage 50. The upper passage is of generally circular cross section, and it has a keyway 52 and receives the lower end of the motor shaft 34, with a key 54 on the shaft extending through the keyway. The bottom of the shaft extends to about the juncture between the upper and lower passages, and a set screw 56 secures the member 46 to the shaft. The lower passage 50 is of noncircular cross section (FIG. 3), and to further secure the member to the shaft, a washer 58 of complementary cross section abuts a shoulder between the passages and a fastener 60 extends through the washer axially into the lower end of the shaft.

A pair of diametrically opposed passages 62 extend through a lower end of the member 46 into communication with the lower passage 50. The passages are tapered to have an increasing diameter in the direction outwardly from the passage 50, within each passage is a ball 64, and the inner diameter of each passage is such as to permit the balls to extend slightly into the passage 50, but to prevent them from moving completely into the passage.

A manually manipulatable cylindrical control means or sleeve 66, having an annular flange 68, is around and slidable axially along the member 46. An annular pocket 70, having a lower tapered surface 72, is defined within the sleeve, a sleeve surface 74 at an upper end of the pocket slides along the upper end of the member, and a sleeve surface 76 at a lower end of the pocket slides along the lower end of the member. With the sleeve in an elevated position as shown, the lower surface 76 engages the balls 64 and holds them in the passages 62 to cause inner ends of the balls to protrude into the passage 50. However, upon movement of the sleeve downwardly along the member, as will be further described, the pocket is brought into communication with the balls, so that the balls may then move radially outwardly of the passage 50 and into the pocket. An O-ring 78 on the member 46 limits upward movement of the sleeve to prevent the balls from falling out of the tapered passages 62.

A pad holder assembly, indicated generally at 80, includes the pad holder 36 carrying the pad 38, and is releasably connected to the motor shaft 34 by the member 46, sleeve 66 and balls 64. The pad holder has a circular recessed area 82 in its upper end, and a circular drive plate 84 within the recess is attached to the pad holder. An annular spring plate 86 is mounted on the drive plate within the recess, and also fastened to the drive plate, within a center opening of the spring plate, is a circular base 88 of a driver 90. The driver includes a post 92 extending upwardly from the base, which in cross section has circular sides 94 and flats 96 (FIG. 3), so the post is complementary in shape to the passage 50 in the member 46. The post is extendible into the passage, it has a circumferential recess 98 into which radially inner ends of the balls 64 may extend to releasably secure the post within the passage, and a coil spring 100 has a lowermost convolution captured between the spring plate 86 and a tapered circumference of the driver base 88. The post and spring are part of the pad holder release mechanism.

When the pad driver assembly 80 is mounted on the motor output shaft 34 by the pad holder release mechanism 42, as shown in FIG. 2 the spring 100 engages the annular flange 68 and urges the sleeve 66 to an upper "latch" position whereat its lower surface 76 engages the balls 64 and holds them in the passages 62 to cause inner ends of the balls to protrude into the annular driver post recess 98. The balls and recess therefore operate as a detent means to prevent removal of the post 92 from the passage 50 of the member 46, whereby the pad driver assembly is connected to the motor shaft 34 for rotation of the assembly and pad by the shaft.

Removal of the pad driver assembly 80 from the motor shaft 34 for pad changing purposes is accomplished by operating the pedal 40 to raise the pad 38 several inches above the floor, and by removing the shroud 44 to provide access to the assembly and quick release mechanism 42. The operator then simply presses down on the annular flange 68 to slide the sleeve 66 downwardly along the member 46, against the urging of the spring 100, until the lower sleeve surface 76 moves out of contact with the balls 64 and the annular pocket 70 is brought into communication with the balls. At this point, the sleeve is in a lower "release" position, whereupon downward movement of the pad holder assembly and driver post 92, under the influence of gravity, moves the balls out of the recess, through the passages 62 and partially into the pocket to free the driver post 92 for removal from the passage 50. When this occurs, the pad holder assembly simply falls downwardly away from the motor shaft and may be removed from beneath the machine to change the pad. When the pad driver assembly is removed from the machine, it carries with it the spring 100.

To replace the pad driver assembly 80, it is placed beneath the machine with the driver post 92 under and aligned for upward movement into the passage 50 in the member 46. The entire pad holder assembly is then raised vertically to extend the post into the passage. As the post moves into the passage the upper portion of the post, above the annular recess 98, is opposite from the tapered passages 62 by the time the spring 100 engages the annular flange 68 to elevate the sleeve 66. At this point, the post therefore blocks movement of the balls 64 inwardly of the tapered passages and out of the sleeve pocket 70, so the spring cannot move the sleeve upwardly. However, when the post is extended into the passage sufficiently far to place the post recess opposite from the tapered passages, the balls are freed to be moved inwardly and partially into the recess by the tapered surface 72 of the sleeve, since the sleeve is itself then freed to be and is pushed upwardly by the spring. Movement of the balls into the driver post recess locks the pad driver assembly to the motor shaft 34 for rotation by the shaft, whereupon the pedal 40 may be operated to lower the pad against the floor.

The invention therefore provides a novel pad holder release mechanism for floor treating machines, which permits an entire pad holder assembly, with pad attached, to conveniently be removed from a floor treating machine without tools. Once the pad holder assembly is removed and the pad changed, the assembly may conveniently be replaced on the machine, again without tools. The mechanism requires only one sliding element, and when used with a battery powered machine, no heavy lifting is required and the machine need not be tilted to gain access to the pad, so there is no risk of tipping the batteries and spilling battery acid.

While one embodiment of the invention has been described in detail, various modifications and other embodiments thereof may be devised by one skilled in the art without departing from the spirit and scope of the invention, as defined in the appended claims.

What is claimed is:

1. In combination, a floor treating machine having a frame and a rotary output shaft extending from said frame; a pad holder adapted to carry a floor treating pad; and means for releasably connecting said pad holder to an end of said shaft, said releasably connecting means comprising latch means on said pad holder and shaft, said latch means being operative in response to movement together of said pad holder and shaft to connect the same together for conjoint rotation, and manually manipulatable control means operatively connected to said latch means and movable to a release position to cause said latch means to disconnect said pad holder and shaft, said latch means including a tubular member on one of said pad holder and shaft, a post on the other of said pad holder and shaft and extendible into a passage in said tubular member when said pad holder and shaft are moved together, and releasable coupling means for connecting said tubular member to said post in response to sufficient extension of said post into said member, said control means to cause the same to same releasable coupling means to cause the same to disconnect said member and post when said control means is moved to said release position, said releasable coupling means including detent means comprising a groove in the periphery of said post and a ball carried by said tubular member, said ball extending partially into said groove upon sufficient extension of said post into said member to connect said member and post together, and further including means responsive to sufficient extension of said post into said member to yieldably urge said control means to a latch position whereat said control means blocks movement of said ball out of said groove to maintain said member and post connected together, said control means being manually movable against said yieldable urging means to said release position to free said ball for movement out of said groove to disconnect said post and member.

2. In a combination as in claim 1, wherein said tubular member has a radially extending passage, said ball is within said passage and extends partially out of a radially inner end of said passage into said groove when said member and post are connected, and said control means comprises an annular sleeve around and slidable axially along said tubular member between said latch and release positions, said sleeve blocking movement of said ball radially outwardly of said tubular member passage when in said latch position and having a pocket therein that is placed into communication with said passage and ball for movement of said ball out of said groove and through said passage at least partially into said pocket when said sleeve is moved to said release position.

3. In a combination as in claim 2, wherein said sleeve has a radially outwardly extending flange, and said yieldably urging means comprises a spring coupled to said post for engaging said flange and urging said sleeve to said latch position upon sufficient extension of said post into said tubular member.

4. In combination, a floor treating machine having a frame and a rotary output shaft extending from said frame; means for supporting said frame above a surface with said shaft extending generally vertically downwardly from said frame; a pad holder adapted to carry a surface treating pad; means for connecting said pad holder to a lower end of said shaft for rotation of said pad holder and the pad; and means for moving said shaft between a raised position whereat the pad is vertically spaced above the surface and a lowered position whereat the pad engages and treats the surface upon rotation of said pad holder, wherein said means for connecting said pad holder and shaft comprises releasable latch means on said pad holder and shaft, said latch means being operative in response to movement together of said pad holder and shaft to connect the same for conjoint rotation, and manually manipulatable control means connected to said latch means and movable to a release position to cause said latch means to disconnect said pad holder and shaft, whereby upon said shaft being moved to said raised position, said control means is movable to said release position to disconnect said pad driver from said shaft and permit said pad driver and the pad to be removed from beneath said machine for replacement of the pad.

5. In a combination as in claim 4, wherein said releasable latch means comprises a tubular member connected to and extending axially downwardly from a lower end of said shaft, a post connected to and extending axially upwardly from said pad holder and extendible into a passage in said tubular member when said pad holder and shaft are moved together, and releasable coupling means for connecting said post to said tubular member in response to sufficient extension of said post into said tubular member, said control means being operatively connected to said releasable coupling means to cause the same to disconnect said post and member when said control means is moved to said release position.

6. In a combination as in claim 5, wherein said post and said tubular member passage have complementary, noncircular cross sections.

7. In a combination as in claim 5, wherein said releasable coupling means includes detent means.

8. In a combination as in claim 7, wherein said detent means comprises a groove in the periphery of said post and a ball carried by said tubular member, said ball extending partially into said groove upon sufficient extension of said post into said tubular member to connect said post to said member, and including means response to sufficient extension of said post into said member to yieldably urge said control means to a latch position whereat said control means blocks movement of said ball out of said groove to maintain said member and post connected together, said control means being manually movable against said yieldable urging means to said release position to free said ball for movement out of said groove to disconnect said post and member.

9. In a combination as in claim 8, wherein said tubular member beneath said lower end of said shaft has a radially extending passage, said ball is within said passage and extends partially out of a radially inner end of said passage into said groove when said member and post are connected, and said control means comprises an annular sleeve around and slidable axially along said tubular member between said latch and release positions, said sleeve blocking movement of said ball radially outwardly of said tubular member passage when in said latch position and having a pocket therein that is placed into communication with said passage and ball for movement of said ball out of said groove and through said passage at least partially into said pocket when said sleeve is moved to said release position.

10. In a combination as in claim 9, wherein said sleeve has a radially outwardly extending flange, and said yieldably urging means comprises a coil spring around said post and carried by said pad holder for engaging said flange and urging said sleeve to said latch position upon sufficient extension of said post into said tubular member.

* * * * *